US011278109B2

(12) United States Patent
Chavez Garcia

(10) Patent No.: US 11,278,109 B2
(45) Date of Patent: Mar. 22, 2022

(54) DISPOSABLE DEVICE FOR ORAL HYGIENE

(71) Applicant: Diego Chavez Garcia, Guadalajara (MX)

(72) Inventor: Diego Chavez Garcia, Guadalajara (MX)

( * ) Notice: Subject to any disclaimer, the term of this patent is extended or adjusted under 35 U.S.C. 154(b) by 258 days.

(21) Appl. No.: 16/497,647

(22) PCT Filed: Jun. 5, 2017

(86) PCT No.: PCT/MX2017/000057
§ 371 (c)(1),
(2) Date: Sep. 25, 2019

(87) PCT Pub. No.: WO2018/199732
PCT Pub. Date: Nov. 1, 2018

(65) Prior Publication Data

US 2021/0274922 A1 Sep. 9, 2021

(30) Foreign Application Priority Data

Apr. 28, 2017 (MX) ..... MX/u/2017/000189

(51) Int. Cl.
*A46B 5/04* (2006.01)
*A46B 9/02* (2006.01)
(Continued)

(52) U.S. Cl.
CPC ..... *A46B 9/045* (2013.01); *A46B 5/0037* (2013.01); *A46B 5/04* (2013.01); *A46B 5/06* (2013.01);
(Continued)

(58) Field of Classification Search
CPC ..... A46B 5/0037; A46B 5/04; A46B 9/005; A46B 9/025; A46B 9/026; A46B 9/045; A46B 11/0003; A46B 2200/1066
See application file for complete search history.

(56) References Cited

U.S. PATENT DOCUMENTS 5,502,863 A 4/1996 Perkins
5,875,513 A * 3/1999 Reinold ..... A46B 5/04 15/227
(Continued)

FOREIGN PATENT DOCUMENTS

GB 2351015 6/1999
WO WO199702009 1/1997
(Continued)

OTHER PUBLICATIONS

Garcia Chavez, Diego. "Limpieza y Frescura". Prezi, Aug. 23, 2016
On line: retrived https://www.youtube.com/watch?v=wmUKcA0cG8k.

*Primary Examiner* — Randall E Chin
(74) *Attorney, Agent, or Firm* — Defillo & Associates, Inc.; Evelyn A Defillo

(57) ABSTRACT

The present invention includes improvements to a device with bristles that makes it possible to perform oral hygiene tasks to remove quickly impurities in the oral cavity, in particular when the user is travelling and does not carry a toothbrush and, due to time constraints, requires quick and effective cleaning. The cleaning device may also include luffa sponges, water-soluble films, spheres with toothpaste or channels that provide flexibility to a membrane which, when bending, generates a vacuum and is placed on the tongue in order to be used as a toothbrush handle. The device provides a better fitting and handling in the mouth of a user, since it avoids the generation of vacuum when actuated, and also has a membrane surrounded by a cylindrical section that allows its handling since it adapts to the tongue.

6 Claims, 6 Drawing Sheets

(51) Int. Cl.

| | |
|---|---|
| ***A46B 9/04*** | (2006.01) |
| ***A46B 5/00*** | (2006.01) |
| ***A46B 5/06*** | (2006.01) |
| ***A46B 9/00*** | (2006.01) |
| ***A46B 11/00*** | (2006.01) |

(52) U.S. Cl.
CPC ..... *A46B 9/005* (2013.01); *A46B 9/025* (2013.01); *A46B 9/026* (2013.01); *A46B 11/0003* (2013.01); *A46B 11/0072* (2013.01); *A46B 2200/1066* (2013.01)

(56) References Cited

U.S. PATENT DOCUMENTS

| | | | | |
|---|---|---|---|---|
| 6,722,805 | B1 * | 4/2004 | Skinner | A46B 5/04 15/167.1 |
| D533,352 | S | 12/2006 | Bernini | |
| 8,215,959 | B2 * | 7/2012 | Elseri | A46B 1/00 433/216 |
| 2002/0106234 | A1 | 8/2002 | Johnson | |
| 2004/0078910 | A1 * | 4/2004 | Grote | A46B 15/0055 15/106 |
| 2014/0261538 | A1 * | 9/2014 | Elseri | A46B 5/04 134/6 |

FOREIGN PATENT DOCUMENTS

| | | |
|---|---|---|
| WO | WO2006009737 | 1/2006 |
| WO | WO2013166617 | 11/2013 |

* cited by examiner

DISPOSABLE DEVICE FOR ORAL HYGIENE

CROSS REFERENCE TO RELATED APPLICATION

This application is a national stage entry of PCT/MX2017/000057 filed Jun. 5, 2017, under the International Convention and claiming priority over Mexican Patent Application No. MX/u/2017/000189 filed Apr. 28, 2017.

FIELD OF THE INVENTION

The present invention consists in improvements made to a device having bristles that allow rapid oral hygiene and eliminate impurities present in the oral cavity, particularly when the user is ambulant and has made no provision to bring a toothbrush and that by the rush of time requires fast and effective dental cleaning. The device uses elements that are eminently mechanical, so it is considered to be an invention of this type.

BACKGROUND

Oral health represents an element that provides security to people and establishes links to interact with others. Cleaning allows to eliminate bacteria and impurities that are generated in the oral cavity when in contact with food.

The characteristics of humidity and warmth are a means of cultivation conducive to the germination of bacteria that cause bad breath. According to studies of the School of Dental Medicine of Harvard, 615 different types of bacteria are coexisting in the mouth.

Given these circumstances, it is necessary to clean the mouth frequently to avoid the proliferation of bacteria and the oral health and social problems caused by the bad breath.

In the state of the art, there are numerous technologies for performing dental cleaning, such as brushes, adapters for them, chewable and swallowable tablets with aromas, fluorinated, oxygenated to avoid stains, etc. However, most of them require a ritual that people conventionally carry out in private in his house, specifically in the bathroom.

Now, the social dynamics imposes a rhythm of life requiring people to move frequently in a territory distant from the places of rest and where they reside. Therefore, it is necessary to implement efficient and immediately available devices, methods or resources that allow us to maintain oral hygiene to avoid the bacteria blossom in the mouth.

The improvements disclosed in this document were made on the invention corresponding to the Mexican application MX/U/2015/000294 filed in favor of the same applicant. The continuous research process and those elements considered as technical characteristics allow to implement improvements to the invention, which consists in a device with bristles that allow rapid oral hygiene and eliminate impurities present in the oral cavity particularly if the user is ambulant and has made no provision to bring a toothbrush and that by the rush of time requires fast and effective dental cleaning. The invention comprises luffas sponges, water soluble films, spheres with dentifrices or channels that causes a membrane to be flexible, which, when flexed, generates vacuum and is placed on the tongue to be used as a brush handle.

The following belongs to prior art of the present invention:

The international publication WO 2013166617 A1 discloses a disposable oral hygiene device which when chewed by the user allows for his oral and dental hygiene, without the need for water. The device comprises a vegetable fiber support luffa impregnated with a dentifrice, which removes and absorbs elements attached to the teeth and the tongue and cheeks without a rinsing is required. This is device is disposed on a vacuum sealing polymer, which has two compartments, one of which contains the device oral and dental hygiene, and the other contains an alcohol-based gel to provide disinfection of hands before handling. However, this device does not guarantee to clean the entire oral cavity, especially because when moves in the mouth, there could be contact in some areas. Moreover, sometimes the device will not even pass through some areas because the user may provoke said device is addressed to certain parts and not others.

U.S. Pat. No. 5,502,863 describes a toothbrush that is mounted on the user's fingers or in a handle to clean the mouth, which further comprises an abrasive substance to remove impurities and also avoids damage to the environment, when disposed because said toothbrush is made of biodegradable vegetable fiber. However, the use of this invention makes necessary privacy because it is required to introduce the finger in the oral cavity to carry out properly the cleaning and later discarding said device.

There are other technologies, for example, publication WO2006009737 A1 discloses a lamella that dissolves in the oral cavity and generates a coating that eliminates bad breath, but it is not enough efficient to eliminate oral bacteria.

Other technologies propose small brushes comprising inert sponges adapted to be introduced into the mouth, which are kept turning in the mouth. They are environmentally friendly because they are made of biological material.

Finally, there are chewable conventional supports such as chewing gums including an abrasive material to act as biological brushes. However, they include sweeteners that cause cavities and have become a product of habitual consumption, with different smells, flavors that do not they necessarily fulfill the function of oral cleaning. Publication WO 1997002009 describes this type of gums consisting of a gum base composition for chewing gum comprising a mixture of elastomer and abrasive silica, in which the silica has a particle size comprised between 1 and 80 microns which is useful for the manufacture of chewing gum focused on the elimination of bacterial plaque and a pleasant oral odor.

Among the most important advantages being offered by the present invention are:

Portable
Disposable
Discreet
Comfortable
Absorbent
Low cost
Does not require any particular physical space for its use
Friendly to the environment
Among others.

The characteristics of the improvements to a disposable oral hygiene device are clearly shown in the following description and in the accompanying figures; where the same reference signs are followed to indicate the shown parts and figures:

Observations: The following description must be considered as merely illustrative, and not exhaustive.

DETAILED DESCRIPTION OF THE INVENTION

Figure 1:
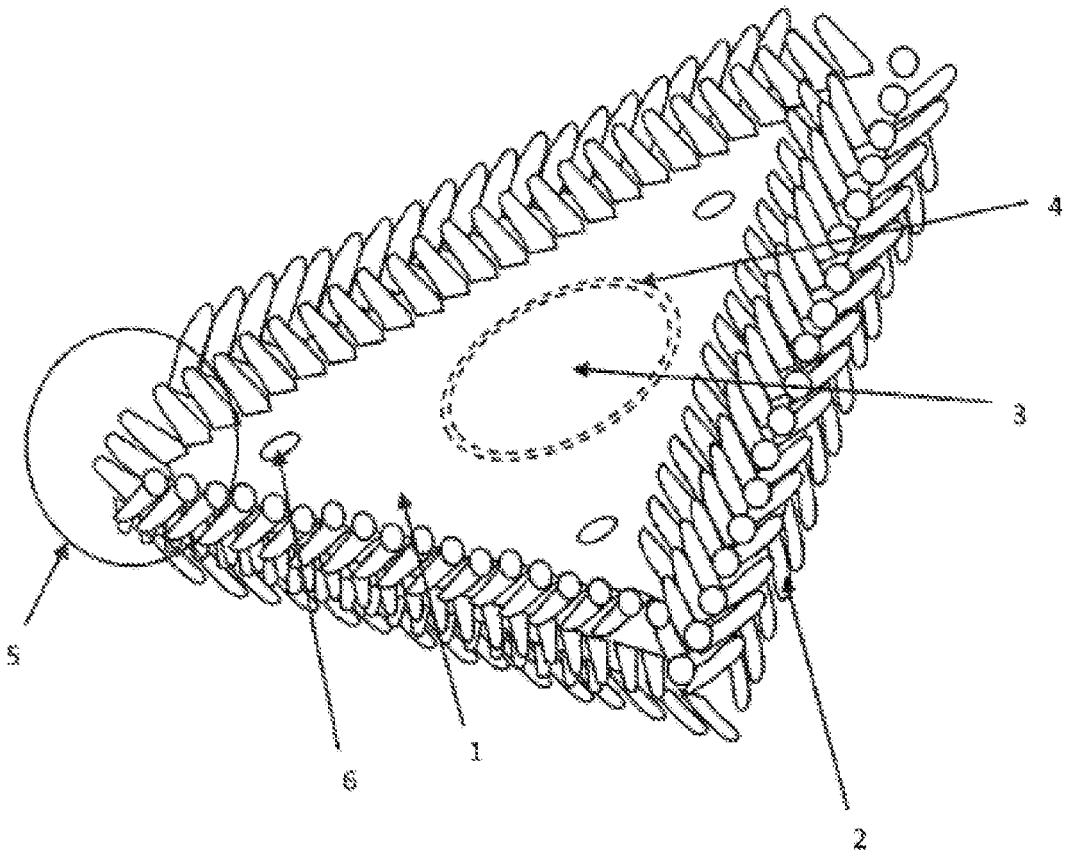
FIG. 1 is a perspective view of the improved disposable device for oral hygiene.
Figure 2:
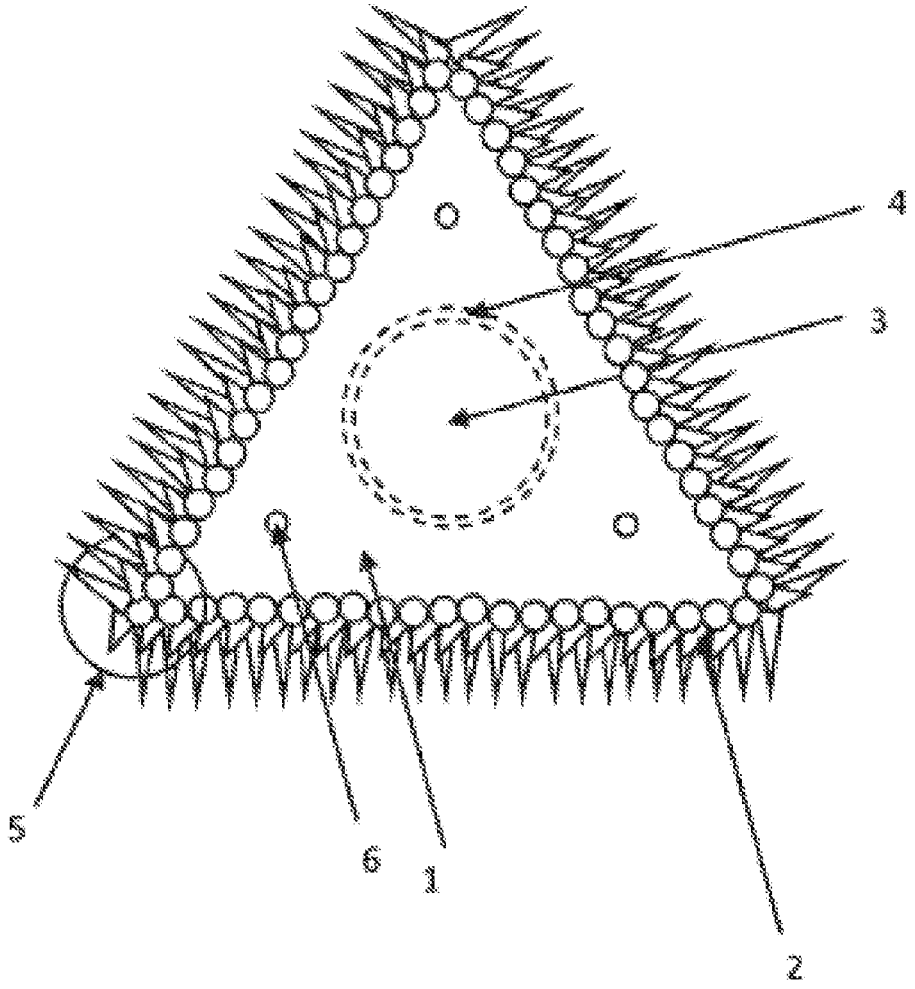
FIG. 2 is a top view of the improved disposable device for oral hygiene.
Figure 3:
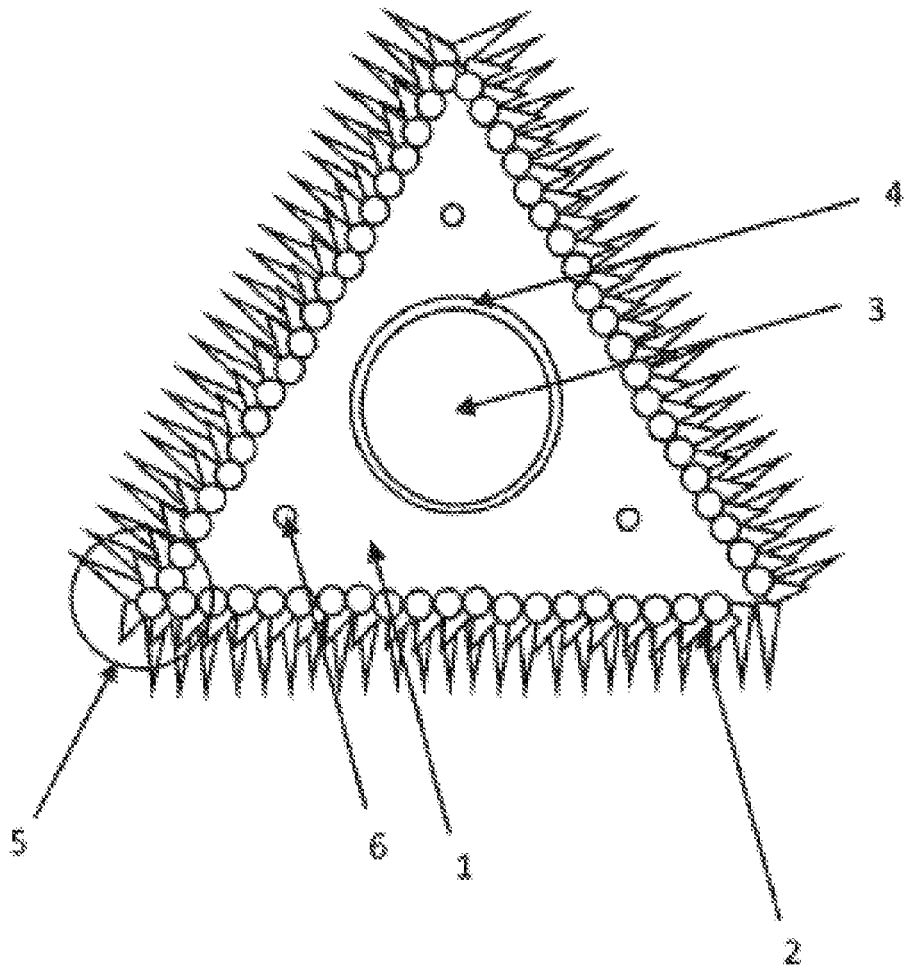
FIG. 3 is a bottom view of the improved disposable device for oral hygiene.
Figure 4:
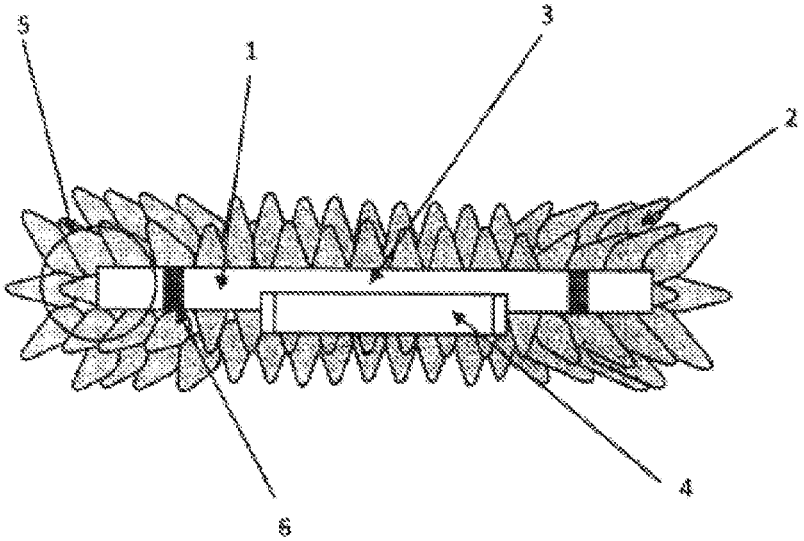
FIG. 4 is a cross-sectional side view of the improvements of the disposable device for oral hygiene.
Figure 5:
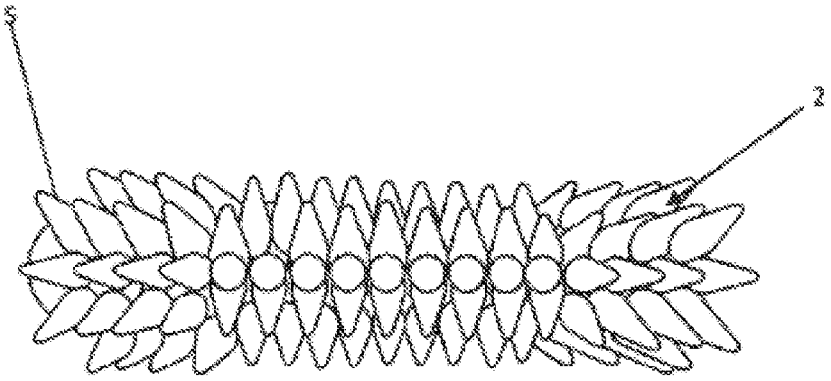
FIG. 5 is a side view of the improved disposable device for oral hygiene, the other side views being substantially the same.
Figure 6:
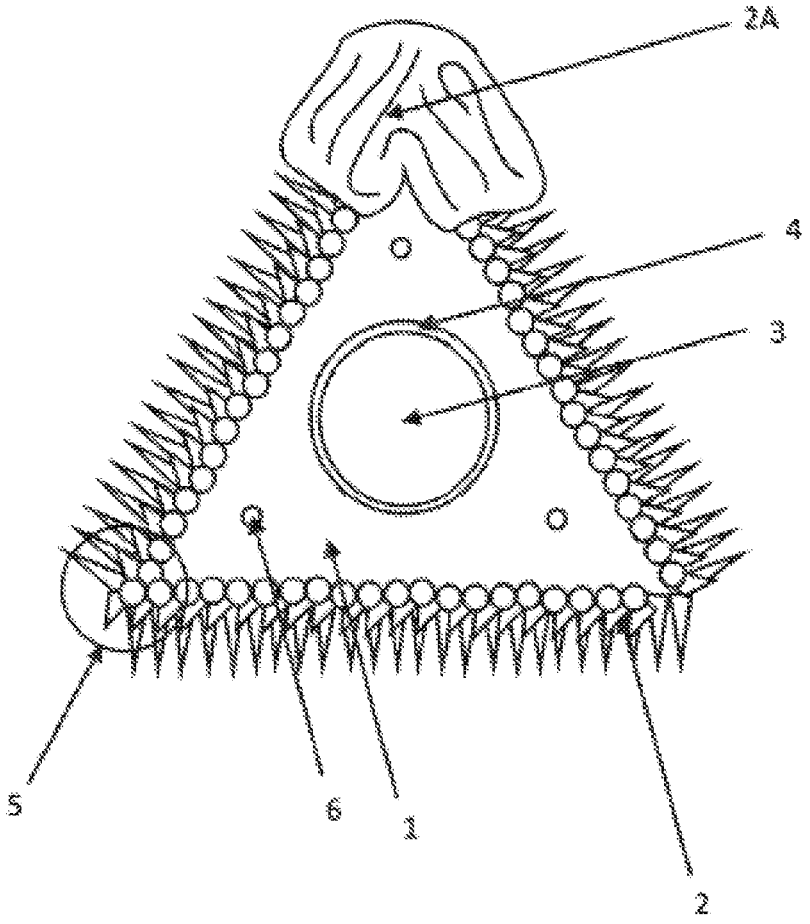
FIG. 6 is a bottom view of the improvements of the disposable device for oral hygiene in a first additional embodiment.
Figure 7:
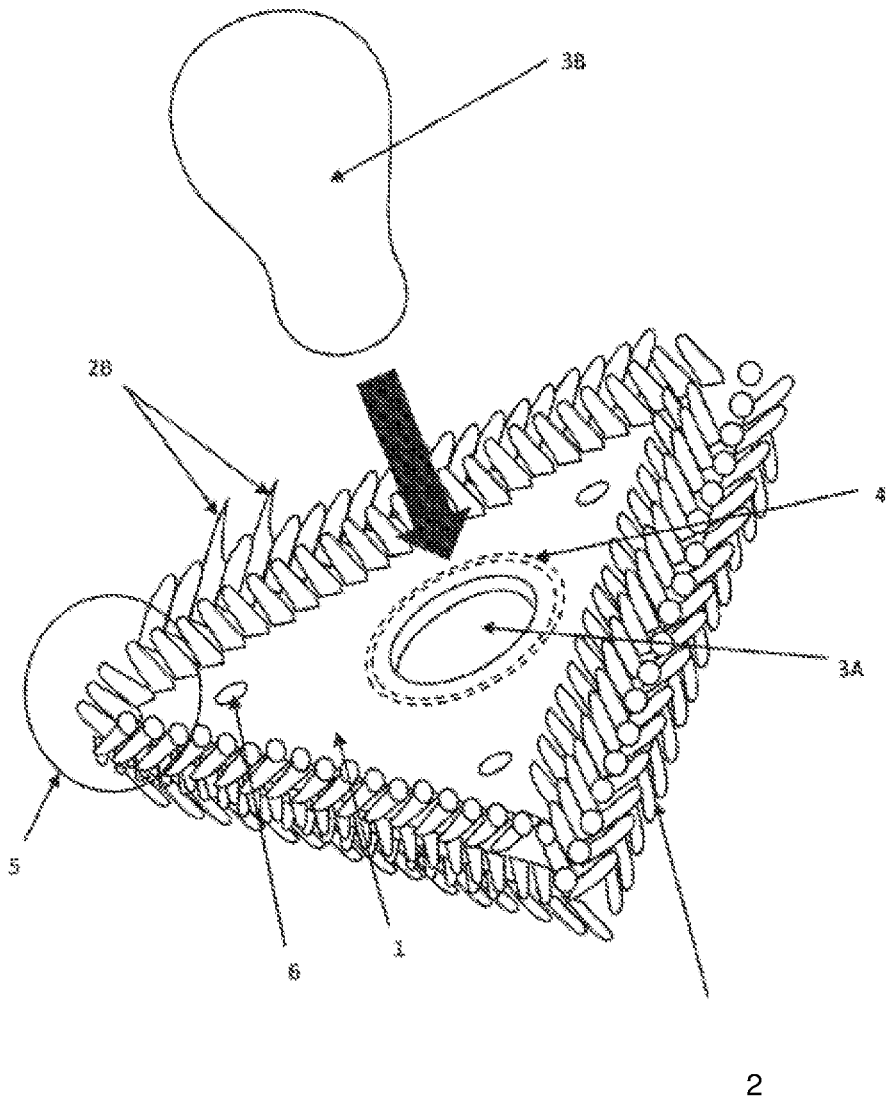
FIG. 7 is a perspective view of the disposable oral hygiene device, which illustrates to a second and third embodiments shown on an exploded view.

The disposable cleaning device for oral hygiene comprises a base (1) in the form of a triangular prism preferably, the periphery of which has at least two flexible irregular bristles (2), and a membrane (3) disposed in the central area of the bottom of the base (1) (See FIG. 3); said membrane (3) being contained within a cylindrical section (4). The base (1), together with the bristles (2) and the membrane (3), form jointly a single piece and all of them are made of the same material. The bending of the corners of the membrane (3) allows the cylindrical section (4) to fit the tongue of user to manipulate the cleaning device as a handle and move it throughout the oral cavity. At least one perforation (6) is disposed between the apexes (5) of the base (1) and the cylindrical section (4), which prevents the cleaning device from sticking to the walls of the oral cavity when used due to absence of air. On this same area, the device may include dentifrice coatings, astringent solutions, gels, or any substance that is used in a conventional way in oral cleaning, which are dissolved by saliva causing the bristles (2) move gently inside the mouth.

Another embodiment of the device described above result from combining the bristles (2) of the base (1) with some luffa sponge sections (2A) adhered by some conventional fastening means to the base (1) to perform the oral rub. Thus, an environmentally-friendly device is obtained because the conventional degradation of the sponge avoids contaminating residues.

Another embodiment of the previously described device consists in providing some longer and sharp bristles (2B) to enter those interdental forms that require a deeper cleaning.

In another embodiment of the invention, the device may include a perforation (3A) in the center of the membrane (3), into which a capsule 3B containing a dentifrice, a flavoring, an astringent substance, a medication, etc. is positioned, such that said capsule dissolves and can contribute to the hygiene or the intake of medications. Perforation (3A) also allows that in case of ingestion of the device by accident, the user may breathe and does not represent a risk to the user's life.

The invention claimed is:

1. A disposable cleaning device for oral hygiene comprising:

a base;

a plurality of rows made of flexible irregular bristles extending along the periphery of said base;

a membrane disposed at a bottom end and substantially in a center of said base;

a cylindrical section disposed at the center of said base, the cylindrical section contains said membrane; and at least one perforation located between each one of the apexes of said base and said cylindrical section;

wherein said at least one perforation prevent the disposable cleaning device from sticking to walls of the oral cavity when used due to absence of air; wherein said base has a triangular prism shape.

2. The disposable cleaning device according to claim 1, further comprising sections of luffa sponge adhered to said base for the oral cleaning.

3. The disposable cleaning device according to claim 1, said membrane comprises a perforation at a center section including a capsule containing dentifrice, astringent solutions, gels, an oral cleaning composition, or a medication.

4. The disposable cleaning device according to claim 3, wherein said perforation allows a user to breathe in case of accidental ingestion of said device.

5. The disposable cleaning device according to claim 1, wherein some of said bristles are longer and pointed to enter areas difficult to access.

6. A disposable cleaning device for oral hygiene comprising:

a base;

a plurality of rows made of flexible irregular bristles extending along the periphery of said base;

a membrane disposed at a bottom end and substantially in a center of said base;

a cylindrical section disposed at the center of said base, the cylindrical section contains said membrane; and at least one perforation located between each one of apexes of said base and said cylindrical section;

wherein said at least one perforation prevent the disposable cleaning device from sticking to walls of the oral cavity when used due to absence of air;

wherein said base, said membrane, said bristles, and said cylindrical section form a single piece and are made of the same material.

* * * * *